US011057971B2

(12) United States Patent
Zhong et al.

(10) Patent No.: US 11,057,971 B2
(45) Date of Patent: Jul. 6, 2021

(54) CHIP-ON-BOARD ILLUMINATING DEVICE

(71) Applicant: XIAMEN ECO LIGHTING CO. LTD., Xiamen (CN)

(72) Inventors: Changhe Zhong, Xiamen (CN); Digen Shen, Xiamen (CN); Jingjing Su, Xiamen (CN); Xiaoping Zhu, Xiamen (CN); Zhongkai Chen, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 19 days.

(21) Appl. No.: 16/795,585

(22) Filed: Feb. 20, 2020

(65) Prior Publication Data

US 2020/0288551 A1 Sep. 10, 2020

(30) Foreign Application Priority Data

Mar. 6, 2019 (CN) ..... 201910169282.0

(51) Int. Cl.

| | |
|---|---|
| ***H05B 45/345*** | (2020.01) |
| ***H05B 45/14*** | (2020.01) |
| ***F21V 33/00*** | (2006.01) |
| ***F21L 4/02*** | (2006.01) |
| ***F21Y 105/10*** | (2016.01) |
| ***F21Y 115/10*** | (2016.01) |

(52) U.S. Cl.

CPC ..... *H05B 45/345* (2020.01); *F21L 4/027* (2013.01); *F21V 33/0008* (2013.01); *H05B 45/14* (2020.01); *F21Y 2105/10* (2016.08); *F21Y 2115/10* (2016.08)

(58) Field of Classification Search

CPC .. F21V 23/003; F21V 23/007; F21V 33/0008; H05B 45/345; H05B 45/14; H05B 45/48; F21L 4/027; F21Y 2105/10; F21Y 2115/10

USPC ..... 315/315

See application file for complete search history.

(56) References Cited

U.S. PATENT DOCUMENTS

| | | | | |
|---|---|---|---|---|
| 2014/0125235 | A1* | 5/2014 | van den Berg | H05B 45/00 315/185 R |
| 2015/0108909 | A1* | 4/2015 | Rupp | H05B 45/37 315/188 |
| 2015/0366009 | A1* | 12/2015 | Lee | H05B 45/345 315/186 |

(Continued)

*Primary Examiner* — Don P Le

(74) *Attorney, Agent, or Firm* — Chun-Ming Shih; Lanway IPR Services

(57) ABSTRACT

A COB illuminating device includes a light source component, a control module, and a base plate component. The light source component includes multiple illuminating sets that are electrically coupled in series. The control module includes multiple control terminals, an input control terminal, an output control terminal and a constant current control unit. The multiple control terminals are respectively and electrically coupled to intersections between the multiple illuminating sets. The input control terminal is electrically coupled to a head illuminating set. The output control terminal is electrically coupled to a tail illuminating set. The constant current control unit is electrically coupled to the multiple control terminals, the input control terminal and the output control terminal. Besides, the constant current control unit activates a dynamic number of illuminating sets starting from the head illuminating set.

16 Claims, 10 Drawing Sheets

(56) References Cited

U.S. PATENT DOCUMENTS

| | | | | |
|---|---|---|---|---|
| 2016/0174305 | A1* | 6/2016 | Kim | H05B 45/48<br>315/201 |
| 2016/0205734 | A1* | 7/2016 | Yoo | H05B 47/10<br>315/191 |
| 2018/0063903 | A1* | 3/2018 | Yamamoto | F21S 8/02 |
| 2018/0063931 | A1* | 3/2018 | Yamamoto | H05B 45/48 |

* cited by examiner

CHIP-ON-BOARD ILLUMINATING DEVICE

FIELD OF THE INVENTION

The present invention relates to a chip-on-board (COB) illuminating device, and more particularly, to a COB illuminating device capable of adapting to multiple types of voltages.

BACKGROUND

A conventional chip-on-board (COB) illuminating device utilizes a light-emitting diode (LED) chip that attaches to a base plate in either a conductive or isolative manner. Also, the LED ship is electrically connected to illuminating components using conductive wires for illuminating purposes.

A conventional COB illuminating device is also called as a COB surface light source. Additionally, the conventional COB illuminating device directly packages the LED chip onto the base plate. Such that packaged LED chip has a short heat-dissipating path and then better heat dissipation, a low fabrication cost, and ignorable faculae that won't affect the illuminating components' visual effects.

Ordinarily, the conventional COB illuminating device has multiple LED chips connected in series, that is, a LED chip set is then formed. Moreover, the LED chip set has an input terminal and an output terminal that are connected to an external control circuit. Such that the external control circuit is capable of controlling the LED chip set as a whole set via both its input terminal and output terminal, for example switching on or off the LED chip set as a whole.

However, the external circuit cannot control the LED chip set by partitions. Therefore, under a condition that the LED chip set is driven by a constant current source, the conventional COB illuminating device can adapt to only one single type of voltage. In this way, the conventional COB illuminating device has a low adaptability to various types of voltages.

SUMMARY OF THE INVENTION

The present invention aims at disclosing a chip-on-board (COB) illuminating device that has better adaptability of various types of voltages.

According to an embodiment of the present invention, the disclosed COB illuminating device includes a light source component, a control module, and a base plate component. First, the light source component includes a plurality of illuminating sets that are electrically coupled in series. And the control module includes a plurality of control terminals, an input control terminal, an output control terminal and a constant current control unit. In addition, the plurality of control terminals are respectively and electrically coupled to intersections between the plurality of illuminating sets. The input control terminal is electrically coupled to a head illuminating set of the plurality of illuminating sets. The output control terminal is electrically coupled to a tail illuminating set of the plurality of illuminating sets. The constant current control unit is electrically coupled to the plurality of control terminals, the input control terminal and the output control terminal. Besides, the constant current control unit activates a dynamic number of illuminating sets out of the plurality of illuminating sets starting from the head illuminating set. And the dynamic number is directly proportional to a voltage level of an input voltage received by the constant current control unit. Second, the base plate component includes a base plate and an insulating package.

The base plate loads both the light source component and the constant current control unit. The insulating package is loaded on the base plate. Moreover, the insulating package covers the light source component.

In one example, an external power source is electrically coupled to the constant current control unit for providing the input voltage.

In one example, the COB illuminating device further includes a rectifier bridge that is electrically coupled to the head illuminating set and the external power source.

In one example, the input voltage is a DC voltage or an AC voltage.

In one example, the base plate includes a heat-dissipating base plate.

In one example, the constant current control unit includes a linear constant current control unit.

In one example, each of the plurality of illuminating set includes a plurality of illuminating units that are electrically coupled in series.

In one example, each of the plurality of illuminating set further includes at least one capacitor coupled to the plurality of illuminating units in parallel.

In one example, each of the plurality of illuminating set further includes a diode that is electrically coupled to a head of the plurality of illuminating units in series.

In one example, the constant current control unit gradually activates the dynamic number of illuminating sets from the head illuminating set to a tail of the dynamic number of illuminating sets.

In another embodiment, the present invention also discloses a COB illuminating device that includes a light source component, a control module, and a base plate component. First, the light source component includes a plurality of illuminating sets that are electrically coupled in series. Second, the control module includes a plurality of control terminals, an input control terminal, an output control terminal and a constant current control unit. The plurality of control terminals are formed in pairs. And each pair of control terminals includes a preceding control terminal and a succeeding control terminal. In addition, each the pair of control terminals corresponds to an intersection between a preceding illuminating set and a succeeding illuminating set out of the plurality of illuminating sets. Furthermore, the preceding control terminal is electrically coupled to the preceding illuminating set. Moreover, the succeeding control terminal is electrically coupled to the succeeding illuminating set. The input control terminal is electrically coupled to a head illuminating set of the plurality of illuminating sets. The output control terminal is electrically coupled to a tail illuminating set of the plurality of illuminating sets. The constant current control unit is electrically coupled to the plurality of control terminals, the input control terminal and the output control terminal. Also, the constant current control unit activates a dynamic number of illuminating sets out of the plurality of illuminating sets starting from the head illuminating set. Besides, the dynamic number is directly proportional to a voltage level of an input voltage received by the constant current control unit. Third, the base plate component includes a base plate and an insulating package. The base plate loads both the light source component and the constant current control unit. The insulating package is loaded on the base plate. In addition, the insulating package covers the light source component.

In one example, an external power source is electrically coupled to the constant current control unit for providing the input voltage.

In one example, the COB illuminating device also includes a rectifier bridge that is electrically coupled to the head illuminating set and the external power source.

In one example, the input voltage is a DC voltage or an AC voltage.

In one example, the base plate includes a heat-dissipating base plate.

In one example, the constant current control unit includes a linear constant current control unit.

In one example, each of the plurality of illuminating set includes a plurality of illuminating units that are electrically coupled in series.

In one example, each of the plurality of illuminating set further includes at least one capacitor coupled to the plurality of illuminating units in parallel.

In one example, each of the plurality of illuminating set further includes a diode that is electrically coupled to a head of the plurality of illuminating units in series.

In one example, the constant current control unit also gradually activates the dynamic number of illuminating sets from the head illuminating set to a tail of the dynamic number of illuminating sets.

These and other objectives of the present invention will no doubt become obvious to those of ordinary skill in the art after reading the following detailed description of the preferred embodiment that is illustrated in the various figures and drawings.

DETAILED DESCRIPTION

As mentioned above, the present invention discloses a COB illuminating device that has better adaptability for various types of voltages in its operations.

Figure 1:
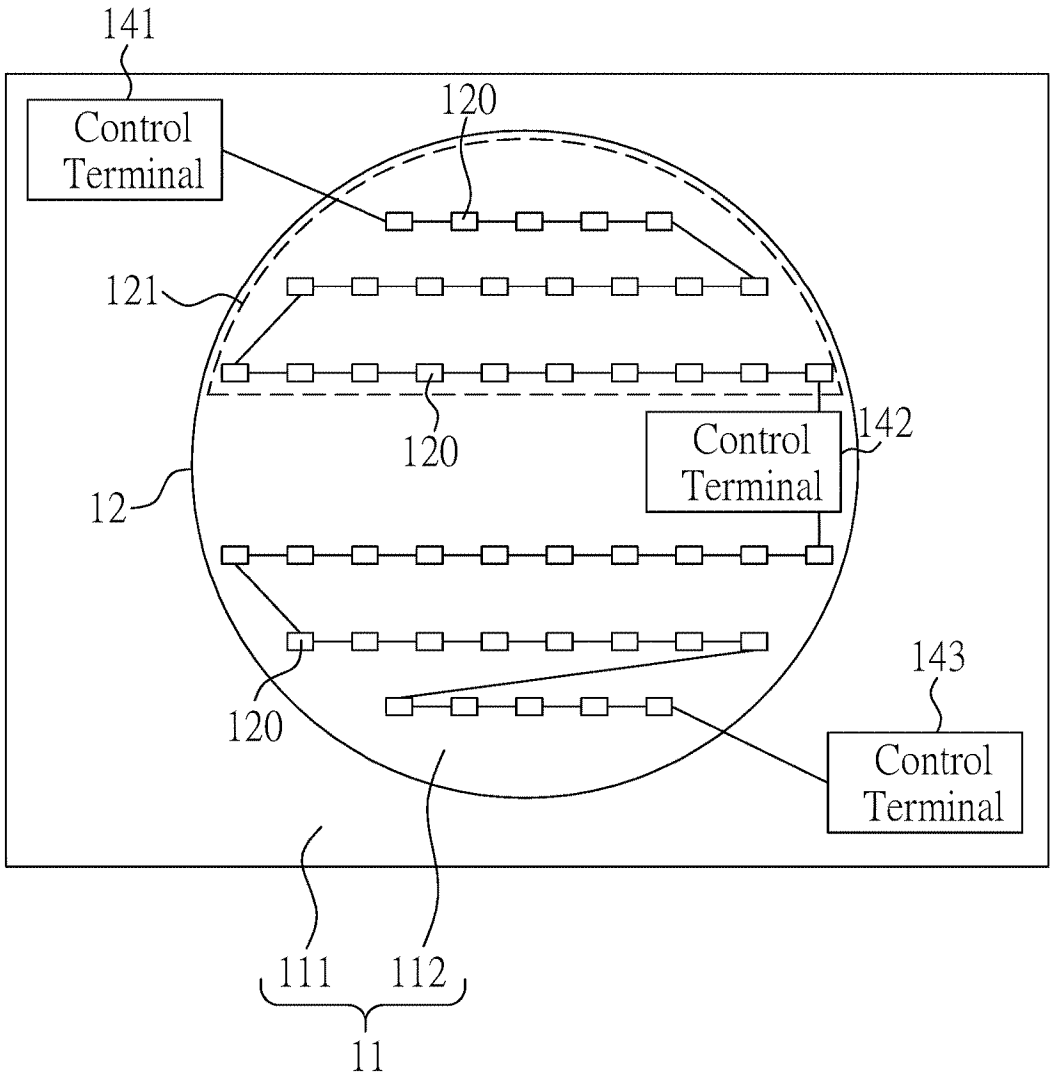
FIG. 1 illustrates a structural view of a COB illuminating device according to a first embodiment of the present invention.
Figure 2:
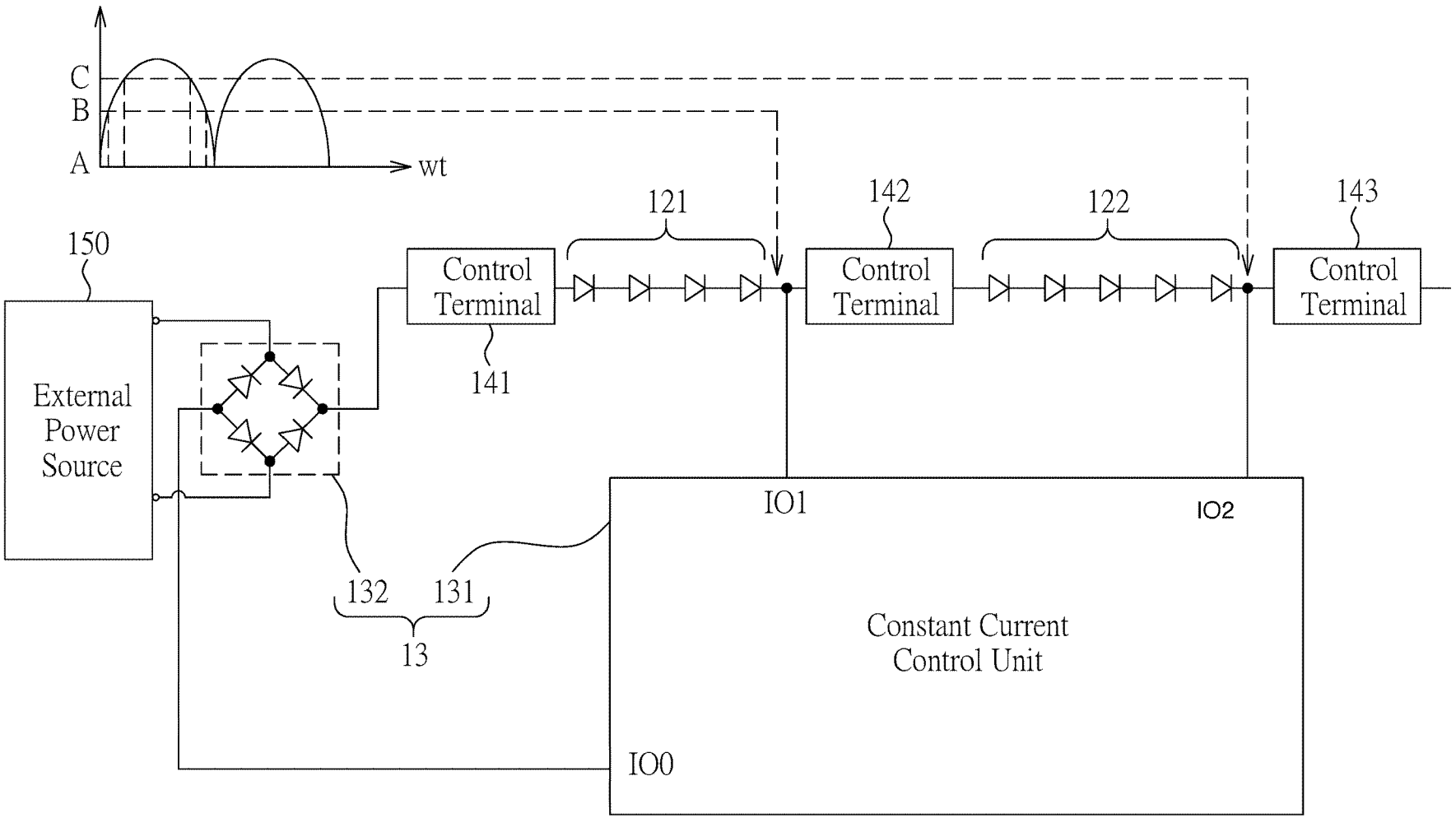
FIG. 2 illustrates a circuitry diagram of the COB illuminating device shown in FIG. 1.

FIG. 1 illustrates a structural view of a COB illuminating device 100 according to one embodiment of the present invention. Also, FIG. 2 illustrates a circuitry diagram of the COB illuminating device 100 shown in FIG. 1 according to one example.

The COB illuminating device 100 includes a base plate component 11, a light source component 12 and a control module 13. The base plate component 11 includes a base plate 111. Also, the light source component 12 is disposed above the base plate 111. In addition, the light source component 12 includes multiple illuminating sets that are electrically coupled in series. And each of the illuminating set includes multiple LED chips 120 that are electrically coupled in series.

The control module 13 includes a constant current control unit 131 that is electrically coupled to a connection between two neighboring illuminating sets. Specifically, a light source unit located at an end terminal of the light source component 12 is electrically coupled to the constant current control unit 131.

The base plate 111 can affix the light source component 12. Such that the base plate 111 is capable of effectively conducting heat generated by the light source component 12. In this way, the base plate 111 supports and conducts heat from the light source component 12 well.

The light source component 12 generates lights under the constant current control unit 131's control. Also, the constant current control unit 131 controls the light source component 12's different partitions' operating statuses according to its received voltage, i.e., an external voltage. It is noted that every illuminating set may have a same or different number of LED chips 120 in examples of the present invention.

For example, when the external voltage is so high enough for a first illuminating set of the light source component 12 can operate normally, the constant current control unit 131 switches on the first illuminating set of the light source component 12 and switches off the other illuminating sets of the light source component 12 simultaneously. Similarly, when the external voltage is so high enough for both the first illuminating set and a second illuminating set of the light source component 12 can operate normally, the constant current control unit 131 switches on both the first and second illuminating sets of the light source component 12 and switches off the other illuminating sets of the light source component 12 simultaneously. By induction, when the external voltage is raised, the constant current control unit 131 in turn switches on more illuminating sets of the light source component 12 from the first set. Such that the light source component 12 can be enlightened by partitions. Then, when the external voltage becomes smaller, the constant current control unit 131 in turn switches off more sets of the illuminating unit from the last set that is previously enlightened. It is noted that since the multiple sets of the light source component 12 is electrically coupled in series, the constant current control unit 131's switching-on or switching-off on the light source component 12's different illuminating sets is conducted in turn.

By partitioning the light source component 12's LED chips 120 into multiple illuminating sets (i.e. partitions), and since each the illuminating set is electrically coupled to the constant current control unit 131, the constant current control unit 131 can switch on or off the light source component 12 by partitions. Specifically, the constant current control unit 131 is capable of switching on or off the light source component 12's different illuminating set according to the external voltage's current level. In this way, the COB illuminating device 100 adapts to various types of external voltages, such as 100 volts, 120 volts, 220 volts or 230 volts.

The COB illuminating device 100's applicability is raised for a wider technological field as a result.

On top of that, since the light source component 12 can be switched on or off by different partitions, the light source component 12's consumed power can be dynamically adjusted, e.g., by an instant requirement. Specifically, when the light source component 12 requires higher power consumption, the external voltage can be raised for switching on more illuminating sets. On the contrary, when the light source component 12 requires smaller power consumption, the external voltage can be lowered for switching off more illuminating sets. In this fashion, the COB illuminating device 100 is capable of adapting to more types of power consumption requirements.

In one example, the external voltage is a Direct Current (DC) voltage. At this time, the light source component 12's head is electrically coupled to a power source that provides the external voltage, and the light source component 12's tail is electrically coupled to the constant current control unit 131 for performing the abovementioned functions.

Figure 3:
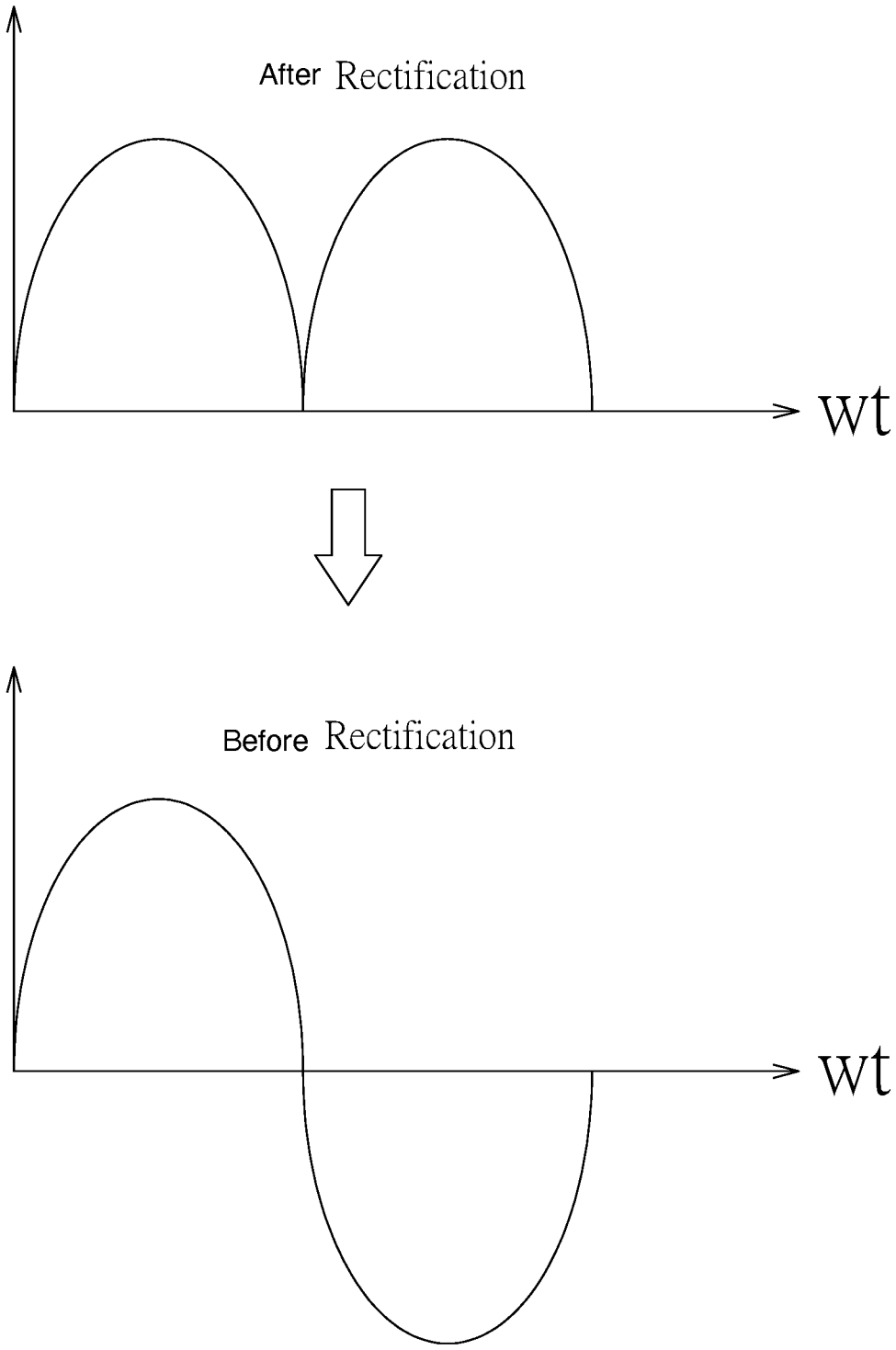
FIG. 3 illustrates a wave diagram of applied external voltage before and after rectification for the COB illuminating device shown in FIGS. 1 and 2.

In one example, the external voltage is an Alternating Current (AC) voltage. As shown in FIG. 2, the control module 13 further includes a rectifier bridge 132 that is electrically coupled to a head (i.e., the first) illuminating set of the light source component 12 and to an external power source 150 that provides the external voltage. More specifically, the rectifier bridge 132 has four terminals. Two of the four terminals are electrically coupled to the external power source 150. Also, one of the other two terminals is electrically coupled to the light source component 12's head illuminating set. In addition, the last one of the other two terminals is electrically coupled to the constant current control unit 131. FIG. 3 illustrates a wave diagram of the COB illuminating device 100's applied external voltage before and after rectification according to one example. The external voltage's waveform has two contrary forms at a front phase and a rear phase. However, after the rectifier bridge 132's rectification, the external voltage's waveform has a same form at its front phase and its rear phase. In this way, a current that flows through the light source component 12's LED chips 120 keeps unchanged during the COB illuminating device 100's operations. Such that the COB illuminating device 100 operates normally.

In one example, the constant current control unit 131 is a linear constant current control unit that is capable of adjusting its factors, such as a power factor, a total harmonic distortion, efficiency, luminous efficacy, or actual power. Also, the linear constant current control unit has a simple structure that has few component and provides a good constant current.

In one example, as shown in FIG. 1, the base plate component 11 additionally includes an insulating package 112 that is loaded on the base plate 111. Besides, the insulating package 112 cover the light source component 12 for shielding its illuminating sets. Such that the insulating package 112 well protects and isolates the light source component 12's illuminating sets. The insulating package 112 may be made of resin or sealant in some examples.

In one example, the light source component 12 includes M illuminating sets and (M+1) connections, where M indicates a positive integer. Also, the constant current control unit 131 has M pins. The light source component 12's head illuminating set is electrically coupled to one of its connection that is also electrically coupled to the rectifier bridge 132. Besides, the light source component 12's every two neighboring illuminating sets is electrically coupled to one corresponding connection of said light source component 12. Similarly, the light source component 12's tail illuminating set is electrically coupled to one connection as well. Each the light source component 12's connection is electrically coupled to a corresponding pin of the constant current control module 131. In some examples, the coupling between the light source component 12 and the constant current control module 131 refers to direct-sampling.

As shown in FIG. 1 and FIG. 2, M is equal to 2. That is, the light source component 12 is partitioned into a first illuminating set 121 and a second illuminating set 122. The first illuminating set 121 is located at the light source component 12's head. And the second illuminating set 122 is at the light source component 12's tail. Also, the light source component 12 includes three connections, i.e., a first connection 141, a second connection 142 and a third connection 143. Moreover, the first connection 141 is electrically coupled to one terminal of the first illuminating set 121. The second connection 142 is electrically coupled in between the first illuminating set 121 and the second illuminating set 122. The third connection 143 is electrically coupled to one terminal of the second illuminating set 122. Additionally, the first connection 141 is electrically coupled to the rectifier bridge 132. It is noted that the constant current control unit 131 has a first pin IO1 and a second pin IO2. The second connection 142 is electrically coupled to the first pin IO1. And the third connection 143 is electrically coupled to the second pin IO2. Also, the first pin IO1 is capable of examining the first illuminating set 121's cross voltage. Similarly, the second pin IO2 is capable of examining a cross voltage that crosses both the first illuminating set 121 and the second illuminating set 122.

When the external voltage is an AC voltage, and when the COB illuminating device 100 is electrically coupled to the external power source 150, a voltage u that crosses the light source component 12 changes periodically. As shown in FIG. 2, first, when the voltage u raises from a point A (at 0 volts) to another point B, the first pin IO1 examines the point B's voltage value. At this time, the first pin IO1 is conducted, and a current flows from the rectifier bridge 132, in turn passes the first illuminating set 121 and the constant current control unit 131 (via the first pin IO1), arrives the rectifier bridge 132, and flows out of the rectifier bridge 132 at last. Under such condition, the constant current control module 131 switches on the first illuminating set 121 and switches off the second illuminating set 122.

When the voltage u raises from the point B to still another point C, the second pin IO2 detects the point C's voltage. At this time, the constant current control unit 131 conducts the second pin IO2. Therefore, a current flows from the rectifier bridge 132, then in turn passes through the first illuminating set 121, the second illuminating set 122 and the constant current control unit 131 (via the second pin IO2), arrives the rectifier bridge 132 and flows out. Under such condition, both the first illuminating set 121 and the second illuminating set 122 are switched on.

When the voltage u keeps on raising from the point C, both the first illuminating set 121 and the second illuminating set 122 are switched on. After, when the voltage u drops below the point C but still above the point B, the second pin IO2 detects the voltage u's instant value. At this time, the constant current control unit 131 switches off the second pin IO2 and still switches on the first pin IO1. In this way, a current flows from the rectifier bridge 132, then in turn passes the first illuminating unit 121 and the constant current control unit 131 (via the first pin IO1), arrives at the rectifier bridge 132 and last flows out. Under such condition, the first illuminating set 121 keeps being switched on, whereas the second illuminating set 122 is switched off.

When the voltage u keeps dropping and reaches below the point B, the first pin IO1 detects the voltage u's instant value. At this time, the first pin IO1 is switched off, and the first illuminating set 121 is switched off correspondingly.

In summary, the voltage u raises from the point A (0 volts), reaches points B and C in turn, then drops below the points C and B in turn, and reaches the point A again. In this way, the voltage u's voltage value completes its one single period. During the voltage u's period, the light source component 12 performs the following steps in turn: (1) switch on the first illuminating set 121; (2) switch on the second illuminating set 122; (3) keep switching on the first illuminating set 121 but switch off the second illuminating set 122; and (4) switch off the first illuminating set 121. In this fashion, under the constant current control unit 131's control, the COB illuminating device 100's light source component 12 switches on and off its illuminating sets by partitions in response to various values of the external voltage.

In some examples, when there are more LED chips 120 in the light source component 12, the COB illuminating device 100 has larger power consumption. Therefore, the external voltage can be adjusted to be higher for handling the COB illuminating device 100's increased power consumption. Such that the light source component 12 may have more LED chips 120 that raise the COB illuminating device 100's luminance in turn.

Figure 5:
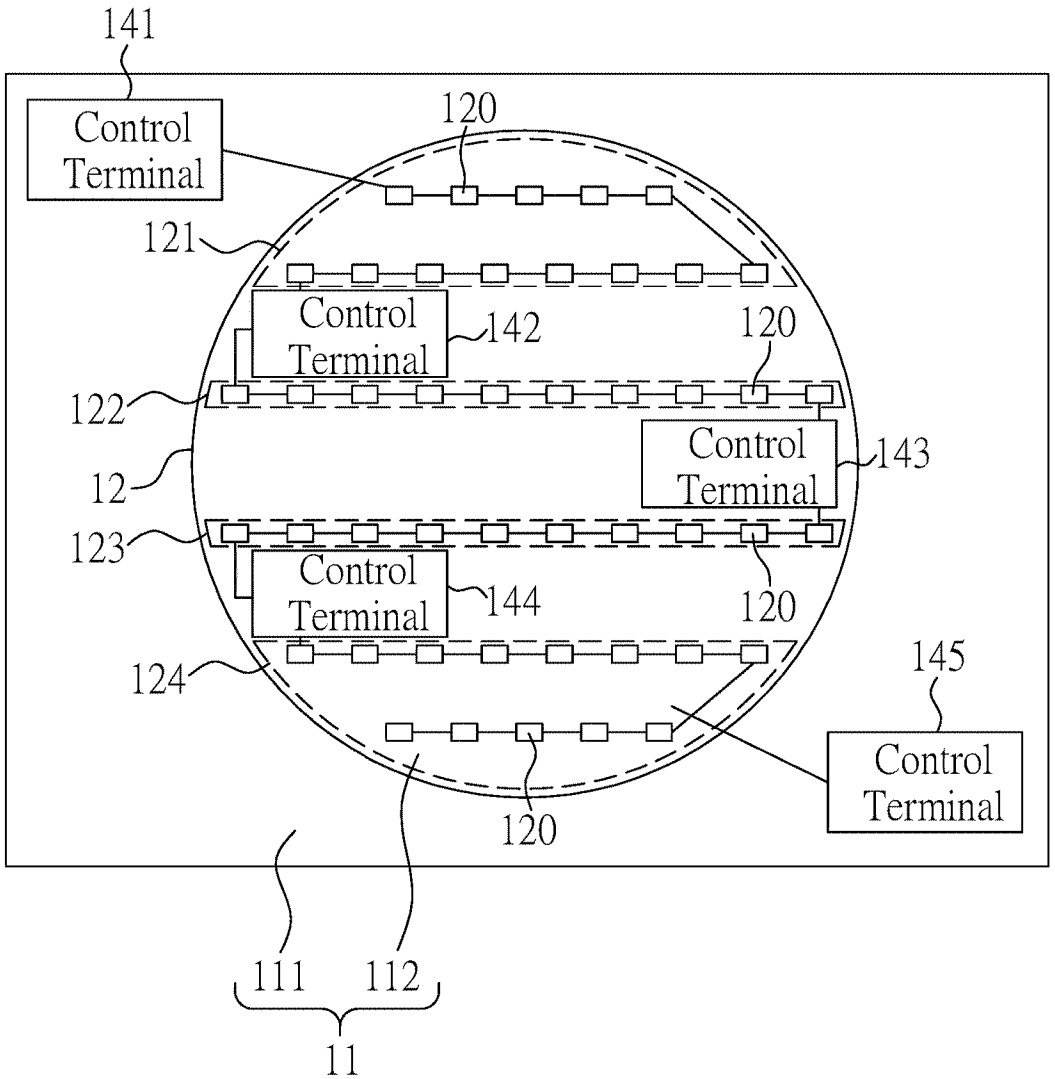
FIG. 5 illustrates a structural view of a COB illuminating device according to a third embodiment of the present invention.
Figure 6:
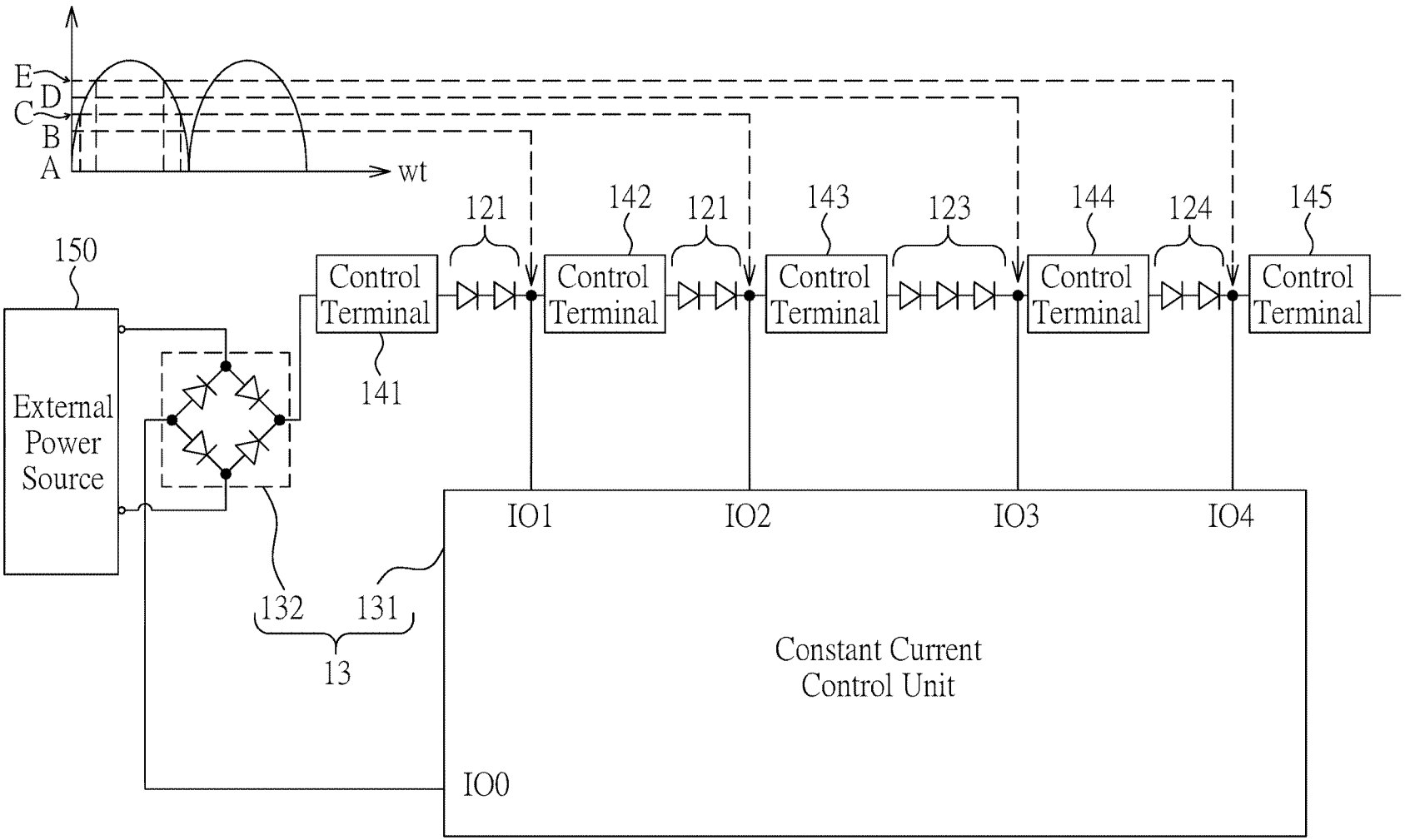
FIG. 6 illustrates a circuitry diagram of the COB illuminating device shown in FIG. 5.

FIG. 5 illustrates a structural view of a COB illuminating device 100 according to a second embodiment of the present invention. Also, FIG. 6 illustrates a circuitry diagram of the COB illuminating device 100 shown in FIG. 5 according to one example. It is noted the value of M is four for the example shown in FIG. 5. That is, there are four illuminating sets in the light source component 12. And they are the first illuminating set 121, the second illuminating set 122, a third illuminating set 123 and a fourth illuminating set 124 in turn. The first illuminating set 121 is located at the light source component 12's head. And the fourth illuminating set 124 is located at the light source component 12's tail. In addition, there are five (i.e., (M+1)) pins in the constant current control unit 131. And they include the first connection 141, the second connection 142, the third connection 143, a fourth connection 144 and a fifth connection 145 in turn. Also, the first connection 141 is electrically coupled to the first illuminating set 121's one terminal. The second connection 142 is electrically coupled in between the first illuminating set 121 and the second illuminating set 122. The third connection 143 is electrically coupled in between the second illuminating set 122 and the third illuminating set 123. The fourth connection 144 is electrically coupled in between the third illuminating set 123 and the fourth illuminating set 124. And the fifth connection 145 is electrically coupled to the fourth light source 124's one terminal. Moreover, the first connection 141 is electrically coupled to the rectifier bridge 132. And the constant current control unit 131 is electrically coupled to the rectifier bridge 132 also. At this time, the constant current control unit 131 has the first pin IO1, the second pin IO2, a third pin IO3 and a fourth IO4. Besides, the first pin IO1 is electrically coupled to the second connection 142. The second pin IO2 is electrically coupled to the third connection 143. The third pin IO3 is electrically coupled to the fourth connection 144. And the fourth pin IO4 is electrically coupled to the fifth connection 145.

Moreover, the first pin IO1 can detect a cross voltage on the first illuminating set 121. The second pin IO2 can detect a cross voltage that crosses both the first illuminating set 121 and the second illuminating set 122. The third pin IO3 can detect a cross voltage that crosses the first illuminating set 121, the second illuminating set 122 and the third illuminating set 123. And the fourth pin IO4 can detect a cross voltage that crosses the first illuminating set 121, the second illuminating set 122, the third illuminating set 123 and the fourth illuminating set 124.

When the external power source 150 provides an AC voltage, and when the COB illuminating device 100 is electrically coupled to the external power source 150, the voltage u that crosses the light source component 12 changes periodically.

As shown in FIG. 6, first, when the voltage u raises from a point A (at 0 volts) to another point B, the first pin IO1 detects the point B's voltage value. At this time, the first pin IO1 is switched on, and a current flows from the rectifier bridge 132, in turn passes the first illuminating set 121 and the constant current control unit 131 (via the first pin IO1), arrives the rectifier bridge 132, and flows out of the rectifier bridge 132 at last. Under such condition, the constant current control module 131 switches on the first illuminating set 121 and switches off the second illuminating set 122.

When the voltage u raises from the point B to still another point C, the second pin IO2 detects the point C's voltage. At this time, the constant current control unit 131 conducts the second pin IO2. Therefore, a current flows from the rectifier bridge 132, then in turn passes through the first illuminating set 121, the second illuminating set 122 and the constant current control unit 131 (via the second pin IO2), arrives the rectifier bridge 132 and flows out. Under such condition, both the first illuminating set 121 and the second illuminating set 122 are switched on.

When the voltage u raises from the point C to the point D, the third pin IO3 detects the point D's voltage. At this time, the constant current control unit 131 conducts the third pin IO3. Therefore, a current flows from the rectifier bridge 132, then in turn passes through the first illuminating set 121, the second illuminating set 122, the third illuminating set 123 and the constant current control unit 131 (via the third pin IO3), arrives the rectifier bridge 132 and flows out. Under such condition, the first illuminating set 121, the second illuminating set 122 and the third illuminating set 123 are switched on.

When the voltage u raises from the point D to the point E, the fourth pin IO4 detects the point E's voltage. At this time, the constant current control unit 131 conducts the fourth pin IO4. Therefore, a current flows from the rectifier bridge 132, then in turn passes through the first illuminating set 121, the second illuminating set 122, the third illuminating set 123, the fourth illuminating set 124 and the constant current control unit 131 (via the fourth pin IO4), arrives the rectifier bridge 132 and flows out. Under such condition, the first illuminating set 121, the second illuminating set 122, the third illuminating set 123 and the fourth illuminating set 124 are switched on.

When the voltage u keeps on raising from the point E, the first illuminating set 121, the second illuminating set 122, the third illuminating set 123 and the fourth illuminating set 124 are switched on. After, when the voltage u drops below the point E but still above the point D, the fourth pin IO4 detects the voltage u's instant value. At this time, the constant current control unit 131 switches off the fourth pin IO4 and still switches on the third pin IO3. In this way, a current flows from the rectifier bridge 132, then in turn passes the first illuminating set 121, the second illuminating set 122, the third illuminating set 123 and the constant current control unit 131 (via the third pin IO3), arrives at the rectifier bridge 132 and last flows out. Under such condition, the first illuminating set 121, the second illuminating set 122 and the third illuminating set 123 keep being switched on, whereas the fourth illuminating set 124 is switched off.

When the voltage u keeps dropping and reaches below the point D but still above the point C, the third pin IO3 detects the voltage u's instant value. At this time, the third pin IO3 is switched off and the second pin IO2 is kept switching on. In this way, a current flows from the rectifier bridge 132, then in turn passes the first illuminating set 121, the second illuminating set 122 and the constant current control unit 131 (via the second pin IO2), arrives at the rectifier bridge 132 and last flows out. Under such condition, the first illuminating set 121 and the second illuminating set 122 keep being switched on, whereas the third illuminating set 123 is switched off.

When the voltage u keeps dropping and reaches below the point C but still above the point B, the second pin IO2 detects the voltage u's instant value. At this time, the second pin IO2 is switched off and the first pin IO1 is kept switching on. In this way, a current flows from the rectifier bridge 132, then in turn passes the first illuminating set 121 and the constant current control unit 131 (via the first pin IO1), arrives at the rectifier bridge 132 and last flows out. Under such condition, the first illuminating set 121 keeps being switched on, whereas the second illuminating set 122 is switched off.

When the voltage u keeps dropping and reaches below the point B but still above the point A, the first pin IO1 detects the voltage u's instant value. At this time, the first pin IO1 is switched off and the first illuminating set 121 is switched off also.

In summary, the voltage u raises from the point A (0 volts), reaches points B, C, D and E in turn, then drops below the points E, D, C and B in turn, and reaches the point A again. In this way, the voltage u's voltage value completes its one single period. During the voltage u's period, the light source component 12 performs the following steps in turn: (1) switch on the first illuminating set 121; (2) switch on the second illuminating set 122; (3) switch on the third illuminating set 123; (4) switch on the fourth illuminating set 124; (5) keep switching on the first illuminating set 121, the second illuminating set 122 and the third illuminating set 123 but switch off the fourth illuminating set 124; (6) keep switching on the first illuminating set 121 and the second illuminating set 122 but switch off the third illuminating set 123; (7) keep switching on the first illuminating set 121 but switch off the second illuminating set 122; and (8) switch off the first illuminating set 121. In this fashion, under the constant current control unit 131's control, the COB illuminating device 100's light source component 12 switches on and off its illuminating sets by partitions in response to various values of the external voltage.

Similarly, when there are more LED chips 120 in the light source component 12, the COB illuminating device 100 has larger power consumption. Therefore, the external voltage can be adjusted to be higher for handling the COB illuminating device 100's increased power consumption. Such that the light source component 12 may have more LED chips 120 that raise the COB illuminating device 100's luminance in turn.

Figure 4:
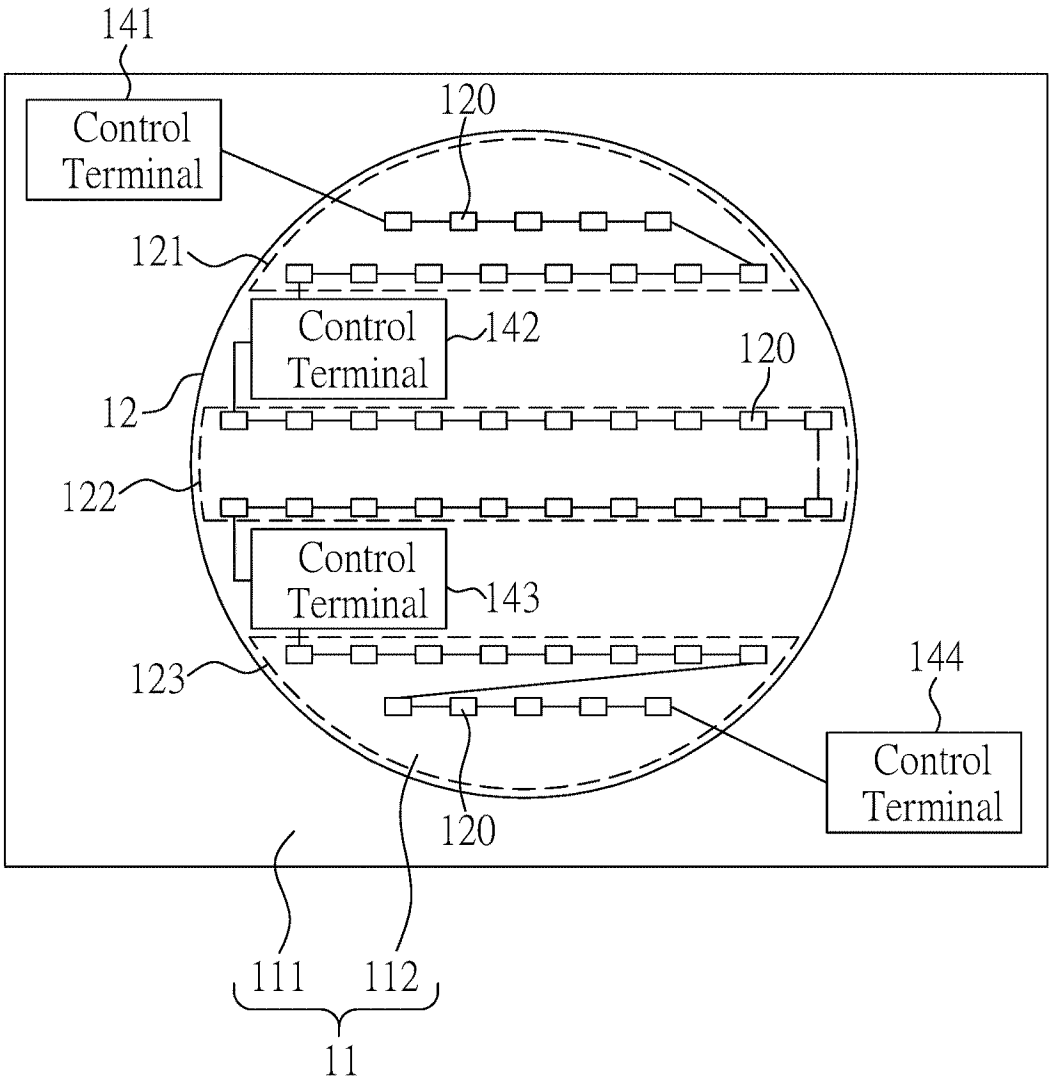
FIG. 4 illustrates a structural view of a COB illuminating device according to a second embodiment of the present invention.

In some examples, the value of M is 3. And the related drawings are illustrated in FIG. 4. The principles of the illustrated COB illuminating device 100 work in the same way as described related to FIGS. 2-3 and 5-6.

In one embodiment, there are N illuminating sets in the light source component 12, where N is a positive integer. Also, there are 2N connections in the light source component 12, and the constant current control unit 131 has N pins. In addition, each illuminating set has a connection at its head terminal and also a connection at its end terminal. The light source component 12's first illuminating set has a head connection that is electrically coupled to the rectifier bridge 132. In addition, any two neighboring illuminating sets of the light source component 12 have two corresponding connections that are electrically coupled to each other and a corresponding pin on the constant current control unit 131. Besides, the light source control unit 12's tail illuminating set has a connection that is electrically coupled to a corresponding pin on the constant current control unit 131. Such circuitry may also be called as independent partitional sampling in series.

Additionally, for avoiding strobes occurred during illumination, and for raising illuminating quality, each illuminating set of the light source component 12 further includes two capacitors disposed at its head and tail. Therefore, when the cross voltage that crosses an illuminating set raises, the capacitors charge themselves. On the contrary, when the cross voltage that crosses an illuminating set lowers, the capacitors discharge themselves correspondingly. Such that the light source component 12's LED chips 120 are substantially immune from strokes caused by significant variations of the external voltage.

Furthermore, for preventing each the capacitor from discharging to its preceding illuminating set, a diode is additionally disposed between any two neighboring illuminating sets. Specifically, a diode is disposed between two neighboring connections of any two neighboring illuminating sets. Also, the light source component 12's head illuminating set's head connection is electrically coupled to the rectifier bridge 132 via a corresponding diode. Since any diode allows only one-way current flow, any capacitor can be prevented from discharging between its two neighboring illuminating sets.

Figure 7:
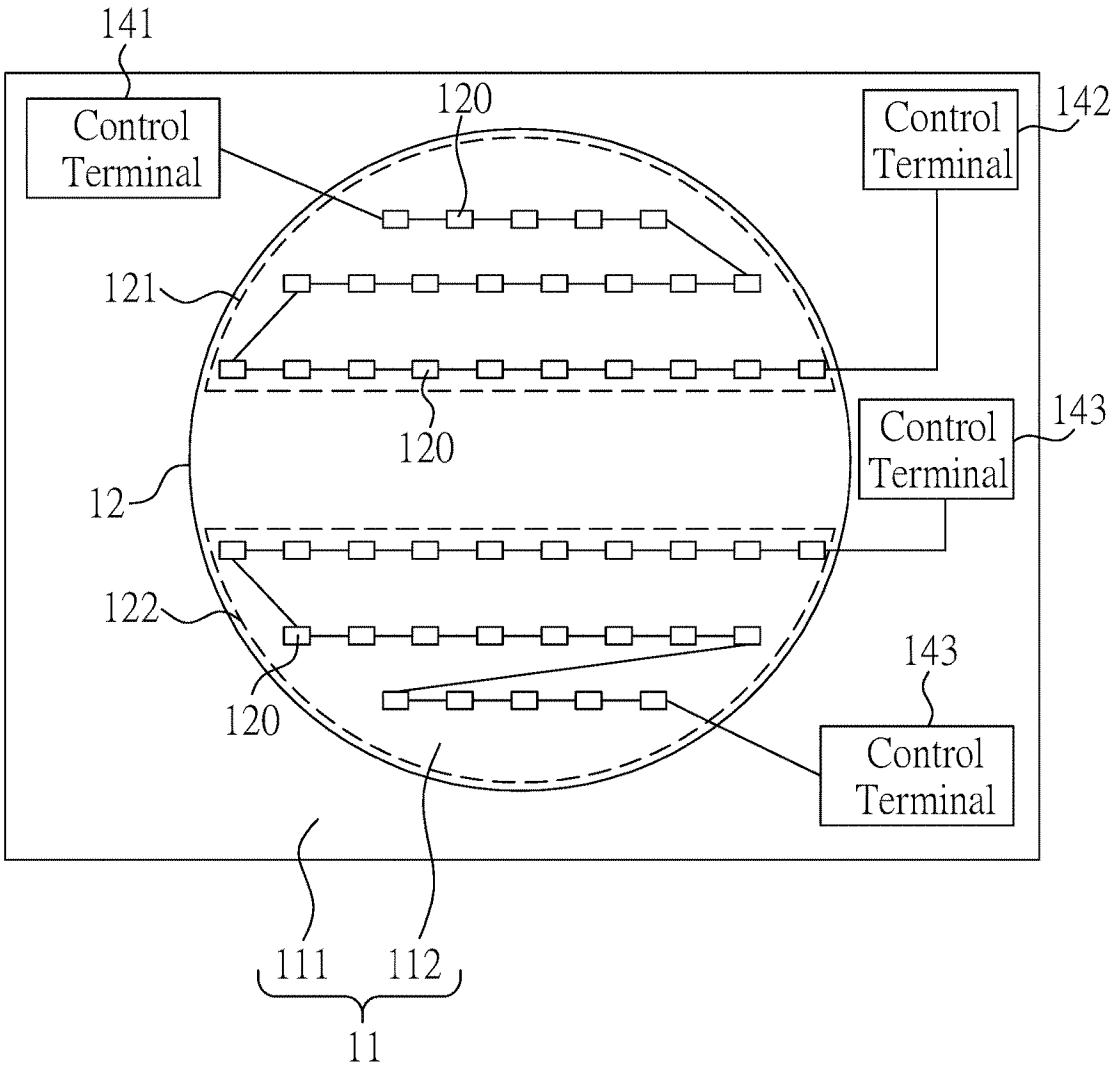
FIG. 7 illustrates a structural view of a COB illuminating device according to a fourth embodiment of the present invention.
Figure 8:
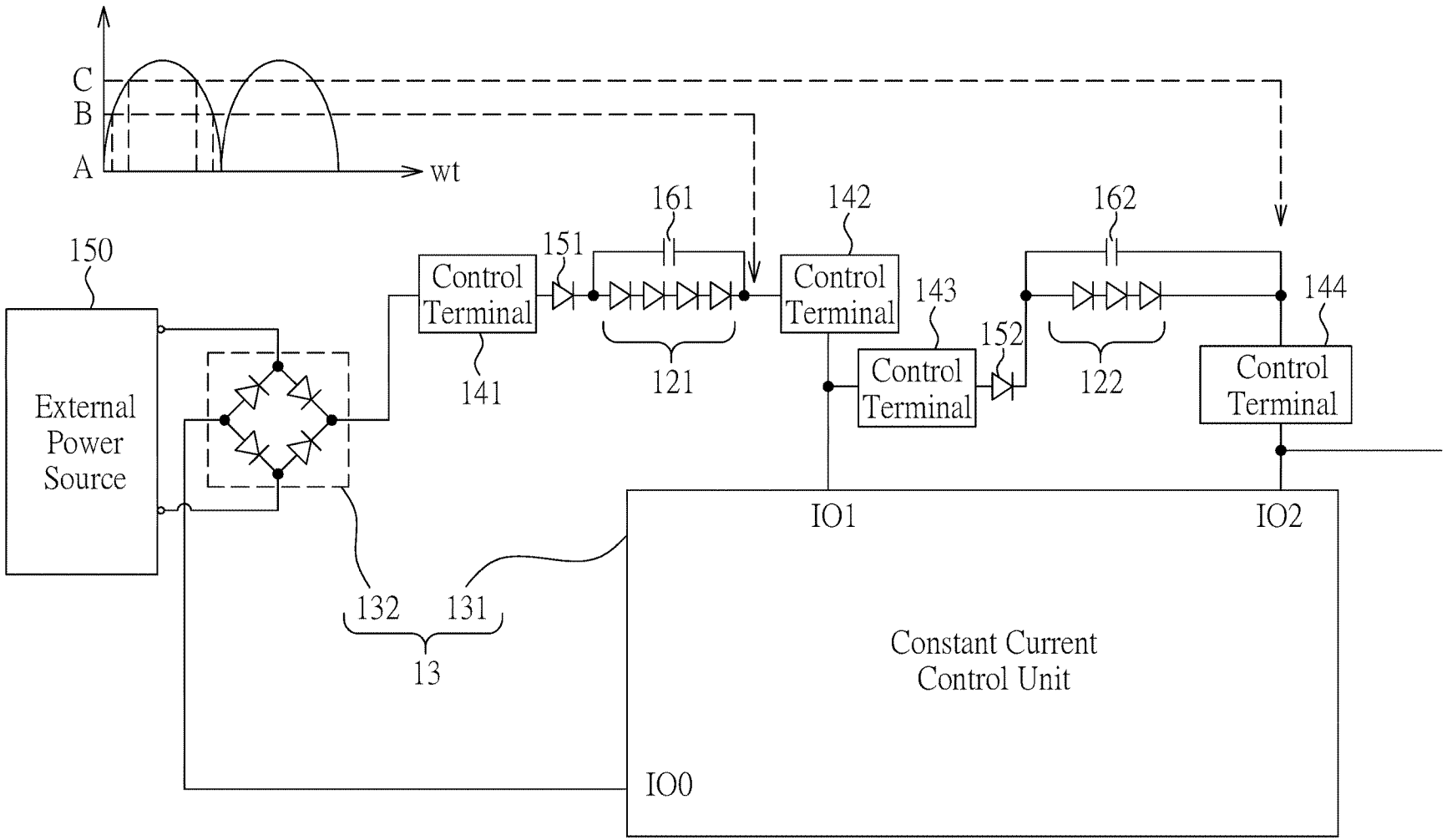
FIG. 8 illustrates a circuitry diagram of the COB illuminating device shown in FIG. 7.

FIG. 7 illustrates a structural view of a COB illuminating device 100 according to one embodiment of the present invention, where N is equal to two. Also, FIG. 8 illustrates a circuitry diagram of the COB illuminating device 100 shown in FIG. 7 according to one example. As shown in FIG. 7, the COB illuminating device 100 includes a first illuminating set 121 and a second illuminating set 122. The first illuminating set 121 is disposed at the light source component 12's head. And the second illuminating set 122 is disposed at the light source component 12's tail. At this time, there are four (2×2, N is equal to two) connections including a first connection 141, a second connection 142, a third connection 143 and a fourth connection 144. In addition, the first connection 141 and the second connection 142 are electrically and respectively coupled to the first illuminating set 121's two terminals. Similarly, the third connection 143 and the fourth connection 144 are electrically and respectively coupled to the second illuminating set 122's two terminals. And the second connection 142 and the third connection 143 are electrically coupled to each other.

The first connection 141 is electrically coupled to the rectifier bridge 132. Also, the constant current control unit 131 is electrically coupled to the rectifier bridge 132 as well. In addition, the constant current control unit 131 includes a first pin IO1 and a second pin IO2. The first pin IO1 is electrically coupled in between the second connection 142 and the third connection 143. And the second pin IO2 is electrically coupled to the fourth connection 144. The first pin IO1 can detect a cross voltage that crosses the first illuminating set 121. The second pin IO2 can detect a cross voltage that crosses the first illuminating set 121 and the second illuminating set 122. Also, a first diode 151 is disposed between the first connection 141 and the rectifier bridge 132. And a first capacitor 161 is disposed between the first illuminating set 121's two terminals. Similarly, a second diode 152 is disposed between the second connection 142 and the third connection 143. And a second capacitor 162 is disposed between the second illuminating set 122's two terminals.

When the external power source 150 provides an external AC voltage, and when the COB illuminating device 100 is electrically coupled to the external power source 150, the voltage u that crosses the light source component 12 changes periodically. Specifically, when the voltage u gradually raises from a start point A1 (i.e., 0 volts) to another point A2 (i.e., a point B1), the first pin IO1 detects the voltage of the point A2. At this time, the constant current control unit 131 conducts the first pin IO1. Such that a current flows from the rectifier bridge 132, then in turn passes through the first illuminating set 121 and the constant current control unit 131 (via the first pin IO1), reaches the rectifier bridge 132 and flows out. In this way, the first illuminating set 121 is switched on. And the second illuminating set 122 is switched off. Also, the first capacitor 161 is charged.

When the voltage u raises from the point B1 to the point B2, the second pin IO2 detects the voltage of the point C. At this time, the constant current control unit 131 switches on the second pin IO2. In this fashion, a current flows from the rectifier bridge 132, then in turn passes through the first illuminating set 121, the second illuminating set 122 and the constant current control unit 131 (via the second pin IO2), reaches the rectifier bridge 132 and flows out. In this way, the first illuminating set 121 and the second illuminating set 122 are switched on. Also, both the first capacitor 161 and the second capacitor 162 are charged.

When the voltage u keeps on raising from the point C, both the first illuminating set 121 and the second illuminating set 122 are switched on. Then, when the voltage u drops below the voltage at the point B2 but still stays above the voltage at the point B1, the second pin IO2 detects the voltage below the point B2. In response, the constant current control unit 131 switches off the second pin IO2 and left the first pin Io1 to be switched on. At this time, the second capacitor 162 discharges, a current flows through the second illuminating set 122, such that the second illuminating set 122 is gradually switched off. Because of a blockage formed by the second diode 152, the current discharged from the second capacitor 162 will not reach the first illuminating set 121. In this way, the first illuminating set 121 is immune from a current change.

When the voltage u drops below the voltage at the point A2, the first pin IO1 detects the voltage below the point A2. In response, the constant current control unit 131 switches off the first pin IO1. At this time, the first capacitor 161 discharges, and a current flows through the first illuminating set 121, such that the first illuminating set 121 is gradually switched off. Because of a blockage formed by the first diode 151, the current discharged from the first capacitor 161 will reach only the first illuminating set 121. In this way, the rest of the light source component 12 is immune from a current change.

In summary, the voltage u in turn raises from the points A1 and A2(B1) and to the point B2 and then in turn drops below the points B2, B1(A2) and A1. During the period, events occur to the light source component 12 in turn include: (1) the first illuminating set 121 is switched on, and the first capacitor 161 is charged; (2) the first illuminating set 121 is kept on being switched on, the second illuminating set 122 is switched on, and both the first capacitor 161 and the second capacitor 162 are charged; (3) the first illuminating set 121 is kept on being switched on, the second illuminating set 122 is switched off, and the second capacitor 162 discharges; (4) the first illuminating set 121 is switched off, and the first capacitor 161 discharges. In this fashion, under the constant current control unit 131's control, the COB illuminating device 100 switches on or off the light source component 12 by partitions, in response to various level of the external voltage. In addition, since the COB illuminating device 100 has larger consumption when it applies more switched-on LED chips 120, the external voltage is dynamically adjusted for switching on more LED chips 120 in some examples.

Figure 9:
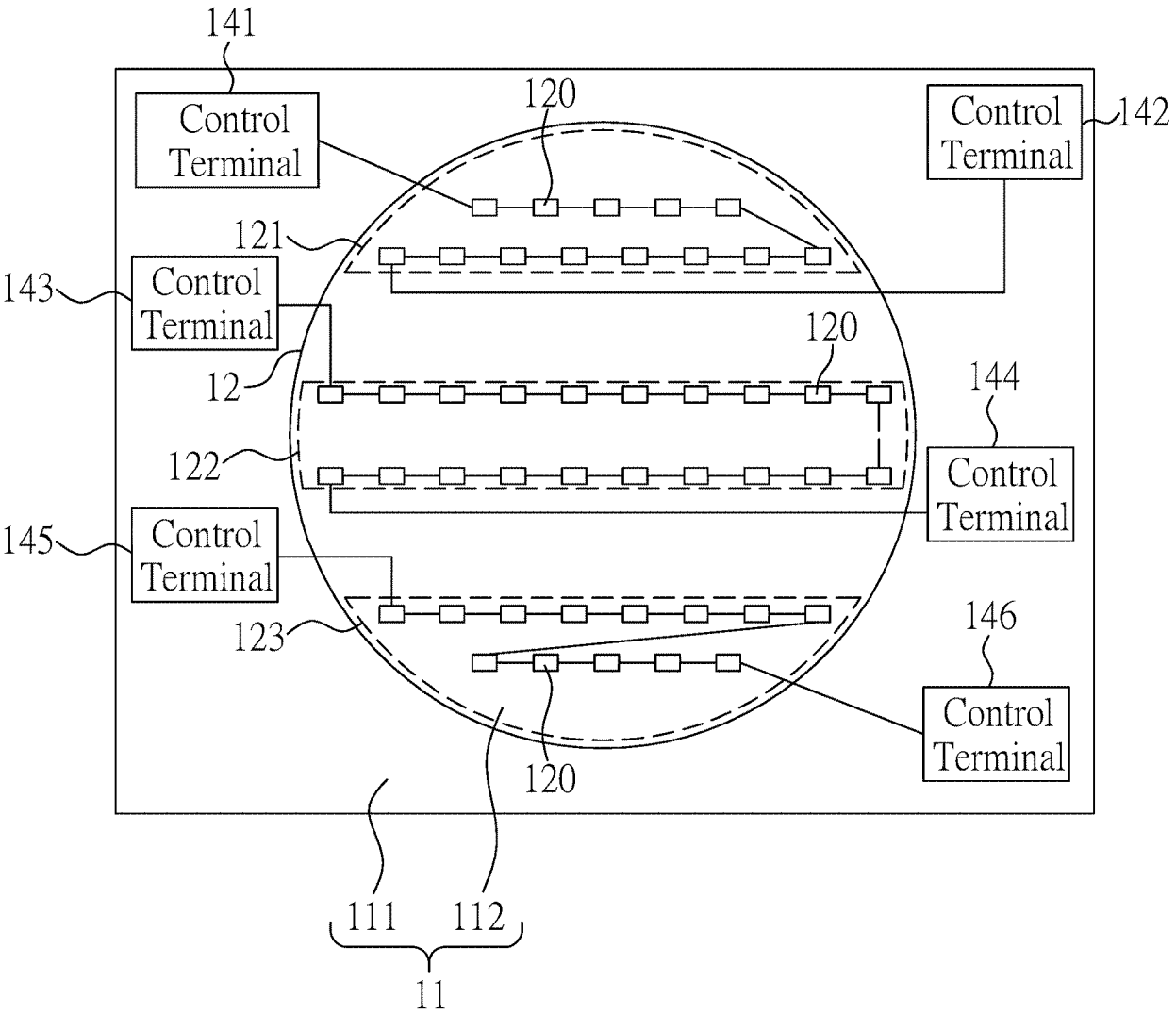
FIG. 9 illustrates a structural view of a COB illuminating device according to a fifth embodiment of the present invention.
Figure 10:
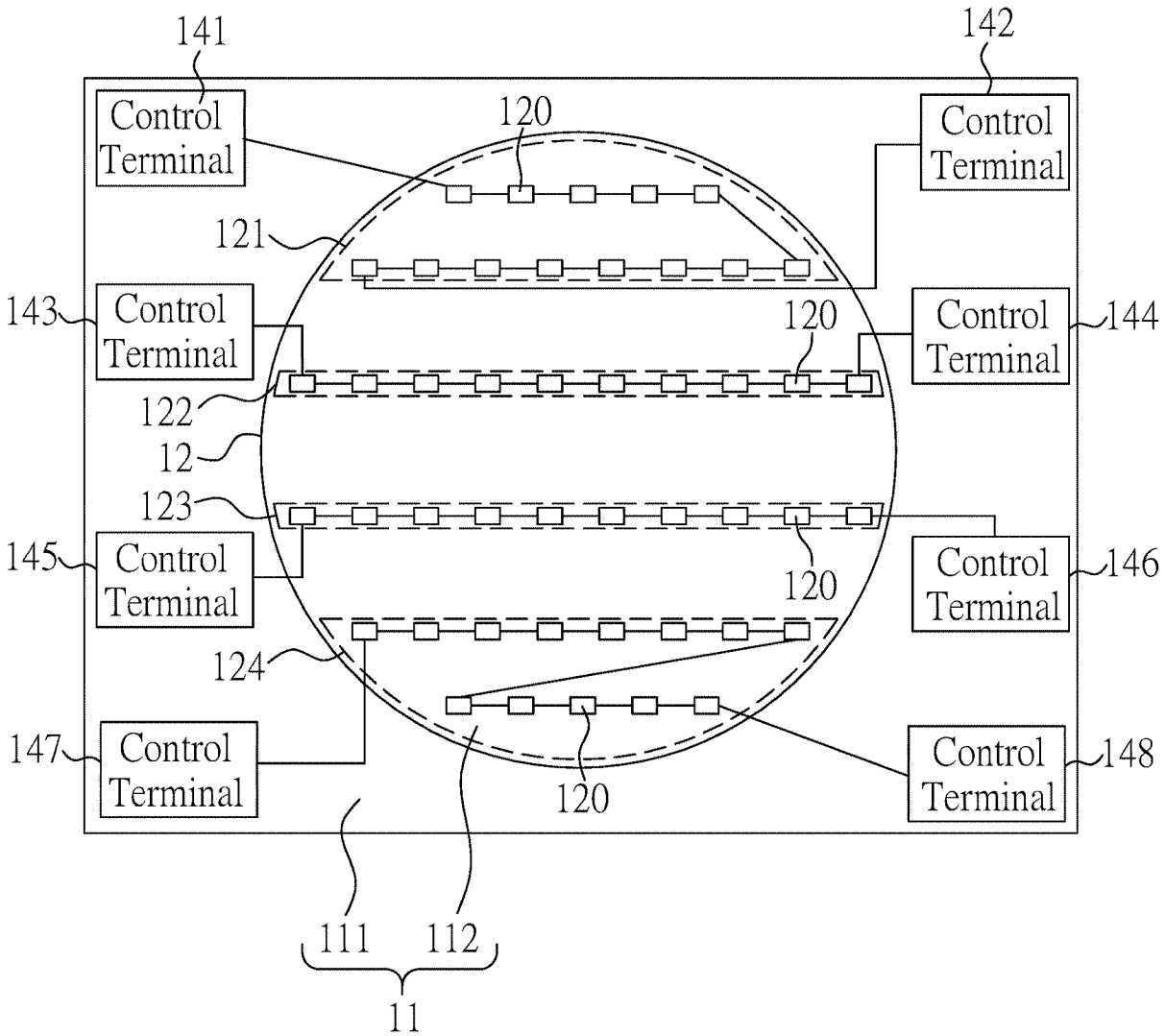
FIG. 10 illustrates a structural view of a COB illuminating device according to a sixth embodiment of the present invention.

In some examples, the value of N is three. As shown in FIG. 9, such that there are six connections in the light source component 120 that includes a first pin 141, a second pin 142, a third pin 143, a fourth pin 144, a fifth pin 145 and a sixth pin 146. Couplings of the six connections can be inducted according to the abovementioned examples and will not be repeatedly explained. Similarly, in some examples, the value of N is four. As shown in FIG. 10, such that there are eight connections in the light source component 120 that includes a first pin 141, a second pin 142, a third pin 143, a fourth pin 144, a fifth pin 145 and a sixth pin 146, a seventh pin 147 and an eighth pin 148. Couplings of these pins are not repeatedly described for brevity.

The COB illuminating device 100 has the following-described advantages.

First, because the light source component 12's LED chips 120 are partitioned into multiple illuminating sets that are electrically and respectively coupled to the constant current control unit 131, the constant current control unit 131 is capable of switching on or off the light source component 12 by different partitions. Also, such partitional switching on or off can be controlled by adjusting the external voltage's level, such that the COB illuminating device 100 has an improved applicability to various types of voltages, such as 100 volts, 120 volts, 220 volts or 230 volts.

Second, the COB illuminating device 100 is capable of adjusting its power consumption. When higher power consumption is desired, the COB illuminating device 100 switches on more illuminating sets. On the contrary, when lower power consumption is desired, the COB illuminating device 100 switches on less illuminating sets. As a result, the COB illuminating device 100 can have a small size, a long service life, and good convenience in operation and adjustment.

Third, the optionally disposed capacitors in each the illuminating set aids in substantially preventing the LED chips 120 from strobes that are caused by voltage changes.

Fourth, the optionally disposed diodes in each the illuminating set effectively prevents each the capacitor from discharging to a preceding illuminating set. Such that the LED chips 120 within can operate in a safe manner. And the COB illuminating device 100 thus extends its service life.

Those skilled in the art will readily observe that numerous modifications and alterations of the device and method may be made while retaining the teachings of the invention. Accordingly, the above disclosure should be construed as limited only by the metes and bounds of the appended claims.

The invention claimed is:

1. A chip-on-board (COB) illuminating device, comprising:

a light source component, comprising:

a plurality of illuminating sets, which are electrically coupled in series;

a control module, comprising:

a plurality of control terminals, respectively and electrically coupled to intersections between the plurality of illuminating sets;

an input control terminal, electrically coupled to a head illuminating set of the plurality of illuminating sets;

an output control terminal, electrically coupled to a tail illuminating set of the plurality of illuminating sets; and a constant current control unit, electrically coupled to the plurality of control terminals, the input control terminal and the output control terminal, and configured to activate a dynamic number of illuminating sets out of the plurality of illuminating sets starting from the head illuminating set, and the dynamic number is directly proportional to a voltage level of an input voltage received by the constant current control unit; and a base plate component, comprising:

a base plate, configured to load both the light source component and the constant current control unit; and an insulating package, loaded on the base plate and configured to cover the light source component, wherein each of the plurality of illuminating set comprises a plurality of illuminating units that are electrically coupled in series, wherein each of the plurality of illuminating set further comprises a diode that is electrically coupled to a head of the plurality of illuminating units in series.

2. The COB illuminating device of claim 1, wherein an external power source is electrically coupled to the constant current control unit for providing the input voltage.

3. The COB illuminating device of claim 2, further comprising:

a rectifier bridge, electrically coupled to the head illuminating set and the external power source.

4. The COB illuminating device of claim 1, wherein the input voltage is a DC voltage or an AC voltage.

5. The COB illuminating device of claim 1, wherein the base plate comprises a heat-dissipating base plate.

6. The COB illuminating device of claim 1, wherein the constant current control unit comprises a linear constant current control unit.

7. The COB illuminating device of claim 1, wherein each of the plurality of illuminating set further comprises at least one capacitor coupled to the plurality of illuminating units in parallel.

8. The COB illuminating device of claim 1, wherein the constant current control unit is further configured to gradually activate the dynamic number of illuminating sets from the head illuminating set to a tail of the dynamic number of illuminating sets.

9. A chip-on-board (COB) illuminating device, comprising:

a light source component, comprising:

a plurality of illuminating sets, which are electrically coupled in series;

a control module, comprising:

a plurality of control terminals formed in pairs, wherein each pair of control terminals comprises a preceding control terminal and a succeeding control terminal and corresponds to an intersection between a preceding illuminating set and a succeeding illuminating set out of the plurality of illuminating sets, the preceding control terminal is electrically coupled to the preceding illuminating set, and the succeeding control terminal is electrically coupled to the succeeding illuminating set;

an input control terminal, electrically coupled to a head illuminating set of the plurality of illuminating sets;

an output control terminal, electrically coupled to a tail illuminating set of the plurality of illuminating sets; and a constant current control unit, electrically coupled to the plurality of control terminals, the input control terminal and the output control terminal, and configured to activate a dynamic number of illuminating sets out of the plurality of illuminating sets starting from the head illuminating set, and the dynamic number is directly proportional to a voltage level of an input voltage received by the constant current control unit; and a base plate component, comprising:

a base plate, configured to load both the light source component and the constant current control unit; and an insulating package, loaded on the base plate and configured to cover the light source component, wherein each of the plurality of illuminating set comprises a plurality of illuminating units that are electrically coupled in series, wherein each of the plurality of illuminating set further comprises a diode that is electrically coupled to a head of the plurality of illuminating units in series.

10. The COB illuminating device of claim 9, wherein an external power source is electrically coupled to the constant current control unit for providing the input voltage.

11. The COB illuminating device of claim 10, further comprising:

a rectifier bridge, electrically coupled to the head illuminating set and the external power source.

12. The COB illuminating device of claim 9, wherein the input voltage is a DC voltage or an AC voltage.

13. The COB illuminating device of claim 9, wherein the base plate comprises a heat-dissipating base plate.

14. The COB illuminating device of claim 9, wherein the constant current control unit comprises a linear constant current control unit.

15. The COB illuminating device of claim 9, wherein each of the plurality of illuminating set further comprises at least one capacitor coupled to the plurality of illuminating units in parallel.

16. The COB illuminating device of claim 9, wherein the constant current control unit is further configured to gradually activate the dynamic number of illuminating sets from the head illuminating set to a tail of the dynamic number of illuminating sets.

* * * * *